United States Patent [19]

Wirth, Jr.

[11] 4,151,521

[45] Apr. 24, 1979

[54] POWER TOOL THEFT ALARM

[76] Inventor: John C. Wirth, Jr., 620 LaJolla, NE., Albuquerque, N. Mex. 87123

[21] Appl. No.: 833,809

[22] Filed: Sep. 15, 1977

[51] Int. Cl.[2] ..... G08B 13/00

[52] U.S. Cl. ..... 340/568; 340/652

[58] Field of Search ..... 340/253 B, 253 R, 256, 340/276, 280

[56] References Cited

U.S. PATENT DOCUMENTS

| | | | |
|---|---|---|---|
| 3,127,597 | 3/1964 | Lewin et al. | 340/280 |
| 3,253,270 | 5/1966 | Downer | 340/280 |

*Primary Examiner*—Alvin H. Waring

*Attorney, Agent, or Firm*—Clarence A. O'Brien; Harvey B. Jacobson

[57] ABSTRACT

The internal impedance loads of a plurality of electrical appliances on display are directly connected in series through their power switches and power cords by a connector strip to form a detection circuit. Interruption of the detection circuit is sensed by a relay to activate a power operated alerting device. Continuity of the detection circuit is maintained by plugging all of the power cords into the connector strip and holding all of the power switches closed by removable binding tape or the like.

10 Claims, 3 Drawing Figures

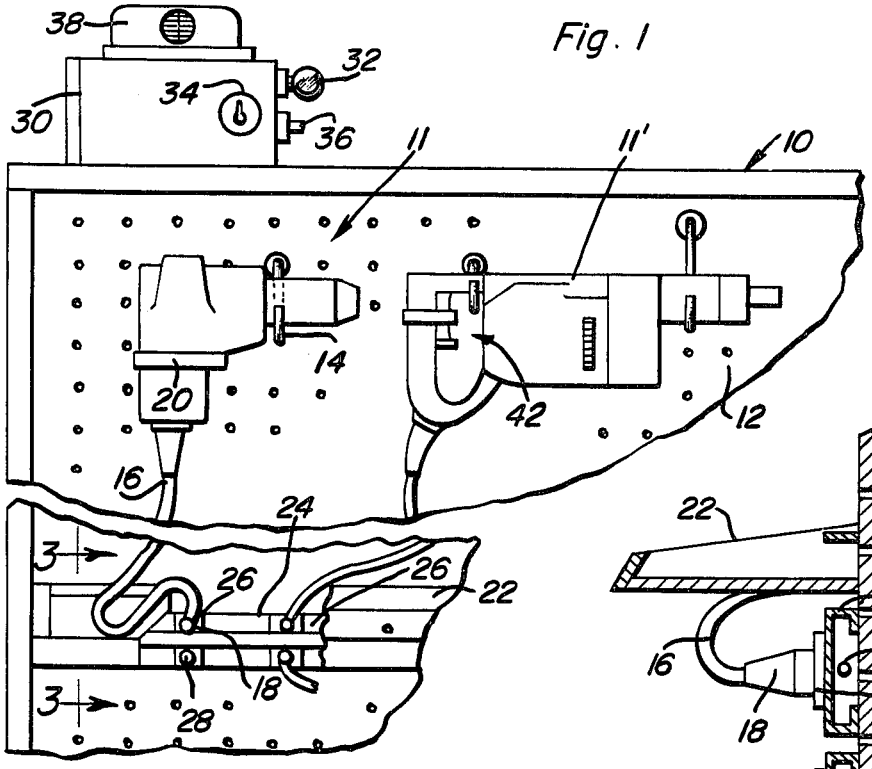
Fig. 1
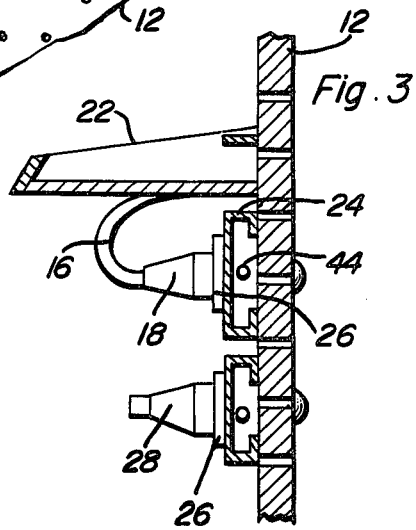
Fig. 3
Fig. 2
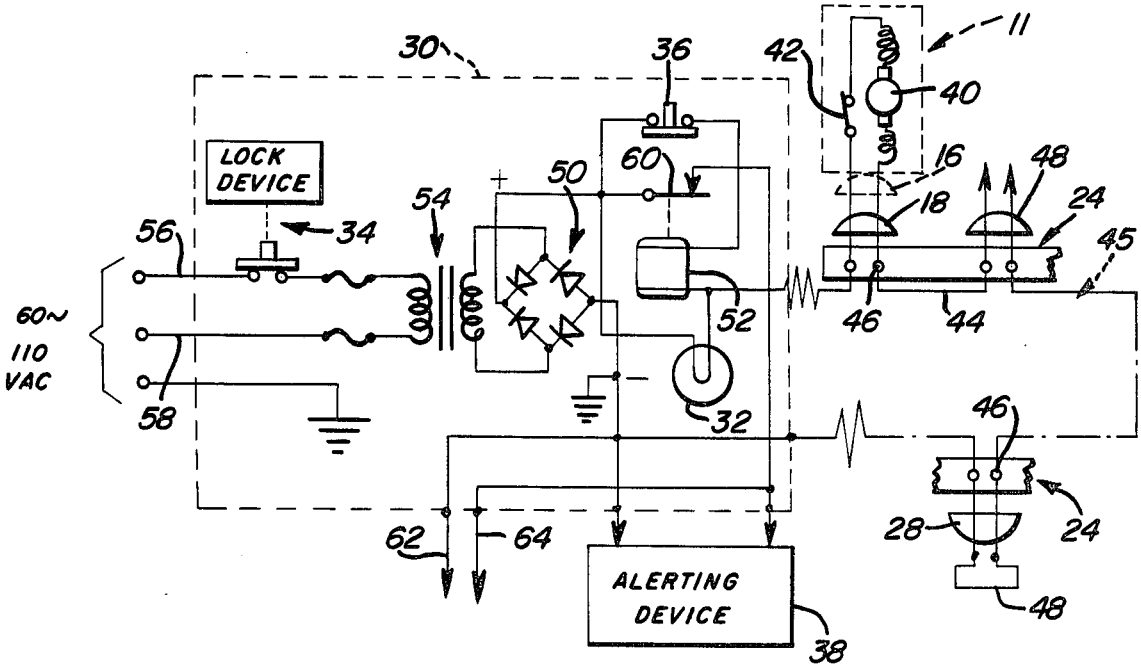

POWER TOOL THEFT ALARM

BACKGROUND OF THE INVENTION

1. Field of the Invention

This invention relates to an anti-theft system that is designed to provide security against theft of power tools or like appliances on display.

Many anti-theft systems have heretofore been devised and patented for discouraging theft of electrical appliances on public display in retail sales establishments. Such anti-theft systems are operative upon removal of an appliance from a display location or disconnection of the appliance from a detection circuit to trigger an alarm. Generally, the anti-theft system either imposes restrictions on customer handling of the protected appliance or requires complicated and expensive detection circuit arrangements.

It is, therefore, an important object of the present invention to provide an anti-theft system of the aforementioned type which will permit handling of the protected applicances by customers including removal from a display board, limited by the length of the appliance power cord, without any expensive or complicated detection circuit arrangement.

2. Prior Art Statement

The inventor is aware of the following U.S. patents that may be deemed relevant:

U.S. Pat. Nos: 2,799,852; 2,913,712; 3,253,270; 3,439,359; 3,444,547; 3,618,065.

It is believed that the foregoing prior art patents are avoided by the claims herein, in a patentable sense.

SUMMARY OF THE INVENTION

In accordance with the present invention, the internal impedance loads of the protected appliances are interconnected in series to form a detection circuit which is in turn connected in series with a relay through which interruption in the detection circuit is sensed to trigger an alarm. The alarm signal may activate an audible or visual alerting device or operate some other theft discouraging equipment such as cameras, door locking mechanisms, etc. Continuity of the detection circuit is established by binding the appliance power switches with adhesive tape to hold them depressed or closed and plugging the power cords into a special connector strip mounted on the display board on which the appliances are displayed. The connector strip includes a plurality of spaced, series connected plug-in receptacles, each of which must receive either the plug of a power cord or a jumper plug to complete the detection circuit.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

FIG. 1 is a partial front elevation view of an appliance display protected by the anti-theft system of the present invention.

FIG. 2 is a circuit diagram depicting the anti-theft system of the present invention.

FIG. 3 is a partial section view taken substantially through a plane indicated by section line 3—3 in FIG. 1.

DETAILED DESCRIPTION OF PREFERRED EMBODIMENT

Referring now to the drawings in detail, FIG. 1 illustrates by way of example, a typical display structure 10 on which a plurality of appliances are mounted, such as power tools 11, 11', etc. In the embodiment illustrated, the display structure may be in the form of a framed pegboard 12 on which power tools are suspended by suitable hooks 14. Each appliance or power tool will include an electrical impedance load such as an electric motor that is adapted to be energized from the usual a.c. voltage source. Accordingly, the appliance or power tool is provided with a trigger-type power switch for establishing an electrical connection to the power source through an appliance power cord 16, for example, having a conventional prong-type plug 18 at an end remote from the power tool. The plug is adapted to be inserted into the usual plug-in power receptacle.

In accordance with the present invention, each of the appliances mounted on the display structure 10 for exhibition in a retail store, for example, has its trigger switch held depressed or in a closed position by means of a strip of removable binding tape 20 adhesively anchored to the appliance housing. Thus, the internal impedance load of the applicance will be directly connected into a series circuit forming a part of the anti-theft system of the present invention, as will be explained hereinafter. It will be appreciated that switch holding tapes will be associated with each of the appliances to hold its power switch depressed and that all of the impedance loads of the appliances form part of the aforementioned series circuit. In one embodiment, the loads of 30 protected power tools form a total circuit impedance of 180 ohms.

With continued reference to FIG. 1 and FIG. 3, the display board 12 mounts below a lower shelf 22 a pair of electrically interconnected connector strip sections 24 on which a plurality of longitudinally spaced, plug-in receptacles 26 are mounted. Each receptacle is adapted to receive the prongs of one of the plugs 18 associated with the power cords 16 of the appliances. Those receptacles 26 to which no appliance is coupled will have a jumper plug 28 inserted therein so as to maintain continuity of the aforementioned series circuit. The connector strip sections 24 are similar to conventional power strips modified from a parallel to a series circuit configuration. The connector strip sections are electrically connected to a control box 30 mounted at any suitable location either adjacent to or remote from the display structure 10. The control box may mount an indicator lamp 32, a key lock operated power switch 34 and a test switch 36. Also, an alerting device 38, such as a buzzer, is electrically connected to the control box and is adapted to produce an alerting signal when any of the appliances on the display structure 10 has its plug 18 withdrawn from the connector strip or a switch holding tape 20 removed to release the trigger switch. It will be appreciated that alerting devices other than a buzzer could be utilized as a substitute for or in addition to the buzzer, including audible and/or visual devices, such as bells, flashing lights, horns, etc.

Referring now to FIG. 2, it will be noted that the appliance or power tool 11 is depicted as having its impedance load 40 in the form of an electric motor electrically connected through its closed power switch 42, power cord 16 and plug 18 to wiring 44 associated with the connector strip 24. The wiring or conductors 44 thus interconnect the terminals 46 associated with each of the receptacles 26 mounted on the strip 24 to form a detection circuit 45. The series detection circuit 45 is completed when each of the receptacles has a plug 18 or 28 received therein. Each plug 28 as aforementioned bridges the terminals 46 of the receptacle with jumper 48 so as to maintain circuit continuity.

The series detection circuit established through the connector strip sections 24 is connected across the d.c. output terminals of a full wave rectifier 50 in series with a relay coil 52 of a single pole, double throw relay through which interruption of the detection circuit is sensed. The impedance of the relay coil 52 is substantially greater than the total impedance of the detection circuit 45. The negative output terminal of the rectifier 50 is grounded as shown to place the tool chassis near ground potential through circuit 45 and thereby prevent shock to customers handling the tools. The input terminals of the rectifier 50 are connected across the secondary winding of a voltage step-down transformer 54 having a primary winding to which the power lines 56 and 58 are connected. A 60 cycle, 110 VAC power supply connected to the power lines 56 and 58 is thereby converted into a 12 VDC voltage applied to the series circuit formed by all of the impedance loads of the appliances and the relay coil 52 which has an impedance approximately 10 times that of the total impedance of all appliance loads. Also connected in series with the relay coil 52 is the normally closed test switch 36. The key lock operated power switch 34 is connected in the power line 56. The indicator lamp 32 is connected across the test switch 36 and relay coil 52 and to the output side of the relay coil so as to provide a meaningful indication of the armed condition of the system. A normally closed relay switch to is associated with the relay coil 52 for connecting the alerting device 38 across the d.c. output terminals of the rectifier 50 in parallel with the series detection circuit. Other or optional relay controlled circuits may be connected in parallel with the alerting device 38 through conductors 62 and 64 for operating devices such as cameras, door closing mechanisms, etc.

The anti-theft system is armed by closing of the power switch 34, with the series circuit completed through the connector strip sections 24 as aforementioned. In this armed condition, the relay coil 52 is energized so as to maintain the relay switch 60 open. The indicator lamp will be simultaneously energized so as to indicate the armed condition of the system. Interruption of the series detection circuit either by unauthorized removal of an appliance or opening of its power switch 42 will, accordingly, cause deenergization of the relay coil 52 causing relay switch 60 to close and thereby connecting the alerting device 38 across the power supply for activating the alerting device and producing an alerting signal. Alternatively, the system may be activated by opening of the test switch 36 in order to determine whether the system is in an operating condition.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a plurality of electrical appliances, each enclosing an electrical load adapted to be connected to a power source through a power cord and a plug upon closing of a power switch for operation of the applicance, an anti-theft system for protecting the appliances disconnected from the power source, comprising: means for holding the power switches closed, connector means engageable with the plugs for electrically connecting all of the electrical loads and the power switches in series, a power operated alerting device, and sensing means connected to the connector means for activating the alerting device in response to opening of any of the power switches or withdrawal of any of the plugs from engagement with the connector means.

2. The combination of claim 1 wherein said connector means comprises an elongated circuit strip mounting a plurality of receptacles receiving the plugs, and wiring means interconnecting the receptacles in series for establishing a detection circuit only through the power switches and the electrical loads of the appliances.

3. The combination of claim 2 wherein said electrical loads include electrical motors of power tool appliances.

4. The combination of claim 3 wherein the power switch holding means comprises adhesive tape holding the power switches in actuated positions.

5. The combination of claim 1 wherein the power switch holding means comprises adhesive tape holding the power switches in actuated positions.

6. The combination of claim 5 wherein said connector means comprises an elongated circuit strip mounting a plurality of receptacles receiving the plugs, and wiring means interconnecting the receptacles in series for establishing a detection circuit only through the power switches and the electrical loads of the appliances.

7. In combination with a plurality of electrical appliances, each having an internal impedance adapted to be connected to a power source through a power cord upon closing of a power switch for operation of the applicance, an anti-theft system for protecting the appliances disconnected from the power source, comprising: means for releasably holding the appliance power switches closed, means detachably connected to the power cords for establishing a common series detection circuit through all of the closed power switches and the impedances of the applicances, and means responsive to interruption of said series detection circuit for producing an alarm signal.

8. The combination of claim 7 wherein said circuit establishing means includes an elongated circuit strip mounted on the displaying means, a plurality of connectors mounted on the strip to which the power cords are detachably coupled, and conductor means interconnecting the connectors in series for establishing said series detection circuit.

9. The combination of claim 1 wherein each of said electrical appliances includes a housing within which the electrical load is mounted and on which the power switch is mounted.

10. The combination of claim 8 wherein each of said appliances includes a housing enclosing the impedance and on which the power switch is mounted, said holding means comprising removable tape anchored to the housing and holding the power switch depressed.

* * * * *